US005540600A

United States Patent [19]

Ivey

[11] Patent Number: 5,540,600

[45] Date of Patent: Jul. 30, 1996

[54] ELECTRICAL CONNECTORS

[75] Inventor: David E. Ivey, Whitchurch, United Kingdom

[73] Assignee: MOD-TAP System, Ayer, Mass.

[21] Appl. No.: 234,476

[22] Filed: Apr. 28, 1994

[30] Foreign Application Priority Data

Apr. 30, 1993 [GB] United Kingdom ..... 9308954

[51] Int. Cl.[6] ..... H01R 4/24

[52] U.S. Cl. ..... 439/417; 439/404

[58] Field of Search ..... 439/395–405, 439/417–419

[56] References Cited

U.S. PATENT DOCUMENTS

| | | | |
|---|---|---|---|
| 3,899,236 | 8/1975 | Santos . | |
| 4,915,645 | 4/1990 | Konnemann et al. | 439/417 |
| 4,975,078 | 12/1990 | Stroede et al. | 439/417 |
| 5,211,575 | 5/1993 | Ustin | 439/417 |
| 5,302,137 | 4/1994 | Suffi | 439/417 |

FOREIGN PATENT DOCUMENTS

| | | |
|---|---|---|
| 0077610 | 9/1982 | European Pat. Off. . |
| 0259082 | 9/1988 | European Pat. Off. . |
| 2115992 | 2/1983 | United Kingdom . |
| 2144930 | 3/1985 | United Kingdom . |
| 2168860 | 12/1985 | United Kingdom . |
| 2173650 | 3/1986 | United Kingdom . |

*Primary Examiner*—David L. Pirlot
*Attorney, Agent, or Firm*—Hamilton, Brook, Smith & Reynolds, P.C.

[57] ABSTRACT

A stuffer cap for an insulation displacement connector comprises a base, a pair of end walls, a pair of side wall and intermediate walls parallel to the end walls. The end walls each have a recess in which is arranged an outwardly extending latch which has a contact point for engaging with a ledge on the connector housing, a contact surface and an engaging point which snaps into a recess in the housing to retain the cap in position. In one embodiment, recesses in the edges of the side walls are replaced by apertures enabling removal of wires with the stuffer cap. In a further embodiment hooks are provided in the recesses which are resilient in the direction of wire insertion and rigid in the direction of wire extraction. In a further embodiment the latch extends inwards and engages with the ledge adjacent that on which the outwardly extending latch engages.

19 Claims, 8 Drawing Sheets

ELECTRICAL CONNECTORS

RELATED APPLICATIONS

This application claims priority to U.K. 93 08954.8 filed 30 Apr. 1993.

FIELD OF THE INVENTION

This invention relates to electrical connectors and in particular to stuffer caps which are used with insulation displacement connectors.

BACKGROUND TO THE INVENTION

An insulation displacement connector comprises a number of insulation displacement contacts mounted in a housing. Insulated wires are attached to the contacts by forcing parallel blades of the contact apart. The inner edges of the blades cut into the plastic insulation and establish electrical contact between the wire and the contact.

In many cases the wires are inserted using a punch-down tool which is placed on the housing over the terminal to be connected and used to apply the necessary force to engage the wire in the contact. The tool may include a cutting device for neat termination of the wire. Punch-down tools are well known in the art.

In other cases it is desirable to use stuffer caps to establish connections between wires and contacts. Stuffer caps may also be used as dust protectors on assembled connectors.

SUMMARY OF THE INVENTION

It is an object of the invention to provide an improved stuffer cap.

It is a further object of the invention to provide an improved latching mechanism for securing the stuffer cap to the insulation displacement connector body.

It is a still further object of the invention to provide for removal of wires engaged with contacts using a stuffer cap.

It is another object of the invention to provide for removal of wires engaged with insulation displacement contacts before the stuffer cap is applied to the connector body.

In accordance with a first aspect of the invention a stuffer cap is provided for use with an insulation displacement connector. The connector has a number of insulation displacement contacts and a body having recesses. The stuffer cap comprises a body having a top, an opposed pair of side walls, an opposed pair of end walls and one or more intermediate walls disposed substantially parallel to or between the pair of end walls. A retaining means is provided for retaining the stuffer cap in position on the connector and comprises a latch means arranged on one or both of the end walls for engagement in a respective recess in the body.

In accordance with a second aspect of the invention a stuffer cap is provided for use with an insulation displacement connector. The connector has a number of insulation displacement contacts and a body having recesses. The stuffer cap comprises a body having a top, an opposed pair of side walls, an opposed pair of end walls and one or more intermediate walls disposed substantially parallel to or between the pair of end walls. A retaining means is provided for retaining the stuffer cap in position on the connector. A plurality of apertures are provided in the side walls which are arranged such that axes of opposed pairs of apertures are aligned with the end walls and the intermediate walls. The apertures are arranged towards free edges of the side walls below the lowermost limit of the end and intermediate walls.

In accordance with a third aspect of the invention a stuffer cap is provided for use with an insulation displacement connector. The connector has a number of insulation displacement contacts and a body having recesses. The stuffer cap comprises a body having a top, an opposed pair of side walls, an opposed pair of end walls and one or more intermediate walls disposed substantially parallel to or between the pair of end walls. A retaining means is provided for retaining the stuffer cap in position on the connector. The free ends of the side walls have recesses therein. Opposite pairs of recesses are aligned with the end and intermediate walls. The recesses have sides having a hook means extending therefrom, each hook means being resilient to force applied in a direction extending from the free ends of the side walls to the top, but rigid to force applied in an opposite direction.

The above and other features of the invention including various and novel details of construction and combination of parts will now be more particularly described with reference to the accompanying drawings and pointed out in the claims. It will be understood that the particular electric connectors embodying the invention are shown by way of illustration only and not as a limitation of the invention. The principles and features of this invention may be employed in varied and numerous embodiments without departing from the scope of the invention.

BRIEF DESCRIPTION OF THE DRAWINGS

Embodiments of the invention will now be described, by way of example, and with reference to the drawings, in which.

DESCRIPTION OF BEST MODE

Figure 1:
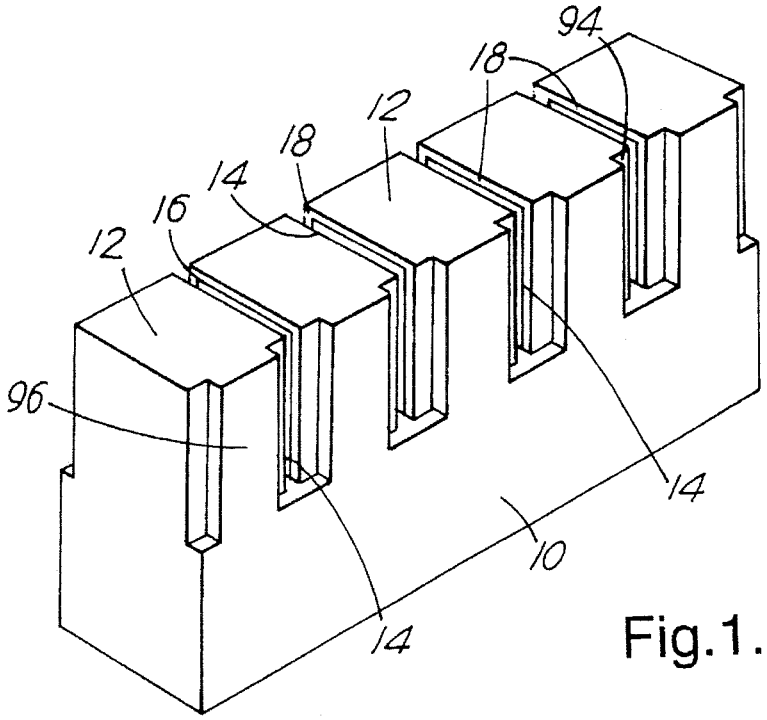
FIG. 1 is a perspective view of an insulation displacement connector with which a stuffer cap embodying the invention is suitable for use.

Insulation displacement connectors of the type shown in FIG. 1 are sold by MOD-TAP Limited of Vincent Avenue, Southampton, England under the trade mark KATT and are described in detail in copending International Application Publication No: WO92/22941 the contents of which are incorporated herein by reference. For the purposes of understanding the present invention it is necessary to understand that the connector housing 10 has a plurality of teeth 12 which retain the insulation displacement contacts. Wires are inserted through slits 14 defined between adjacent teeth. The longitudinal faces 16 of the teeth which oppose one another have a ledge 18 around their periphery. Each insulation displacement contact has a pair of opposed tynes, one tyne of each pair being retained in a recess in each tooth partly defined by the ledge 18, the other of the pair being retained in the adjacent recess.

Figure 2:
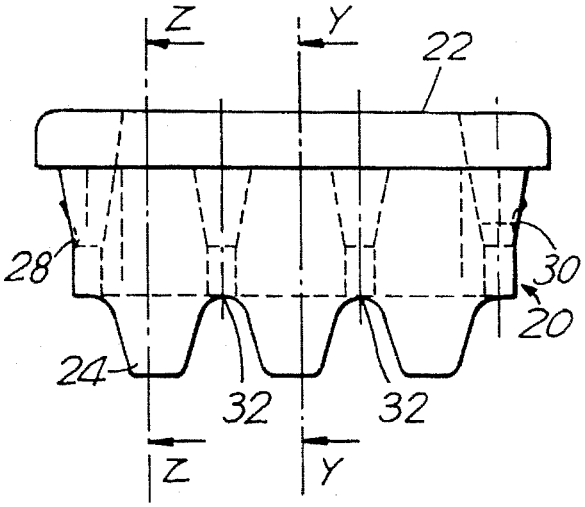
FIG. 2 is a side view of a stuffer cap embodying the invention.
Figure 3:
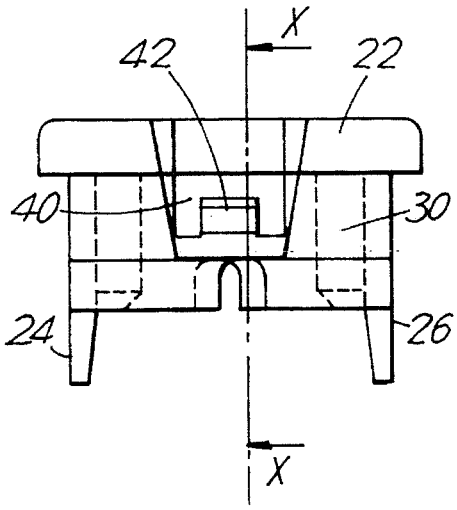
FIG. 3 is an end view of the cap of FIG. 2.
Figure 4:
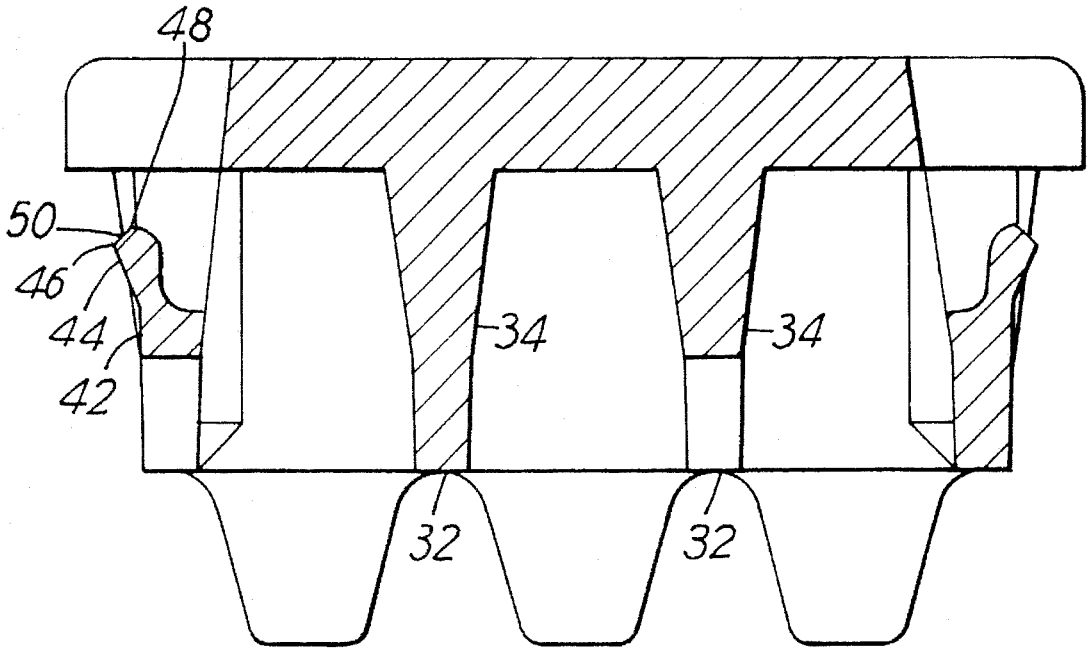
FIG. 4 is a view on the line X—X in FIG. 3.

Referring now to FIGS. 2 to 6, the stuffer cap is intended to sit on top of the teeth of the insulation displacement connector. The cap may be used both for wire insertion and as a dust cap once in position. The cap comprises a body 20 having a substantially flat top portion 22, two depending side walls 24, 26 and two depending end walls 28,30. In the embodiment of FIG. 2, the lower free ends of the side walls have a series of U shaped recesses 32 which, in position on the connector, are aligned with the slits 14 to enable a connected wire to protrude through the side wall of the stuffer cap.

Figure 5:
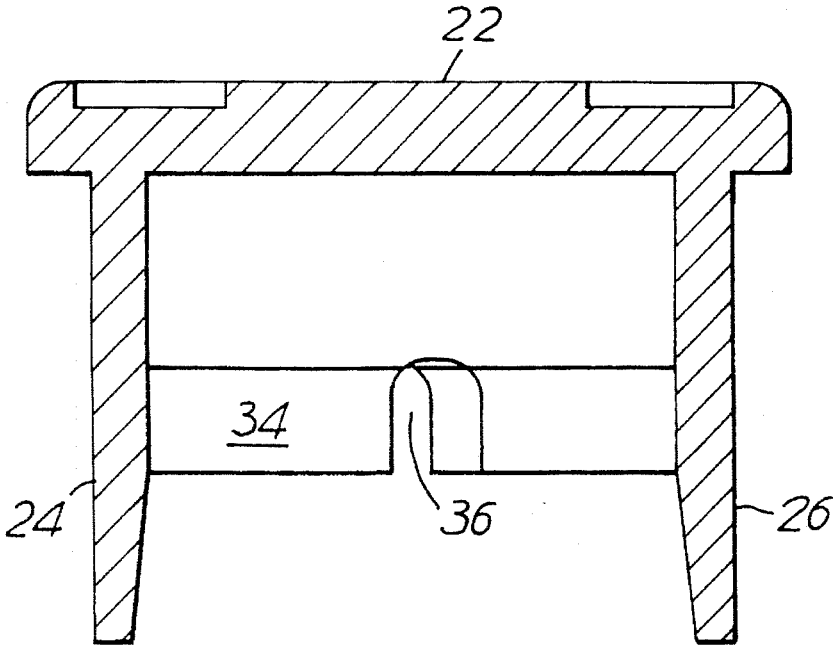
FIG. 5 is a view on the line Y—Y in FIG. 2.
Figure 6:
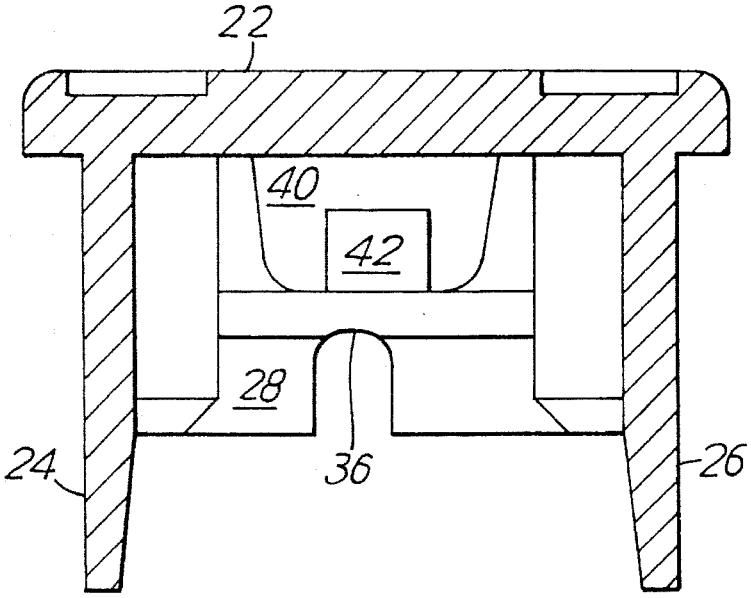
FIG. 6 is a view on the line Z—Z in FIG. 2.
Figure 7:
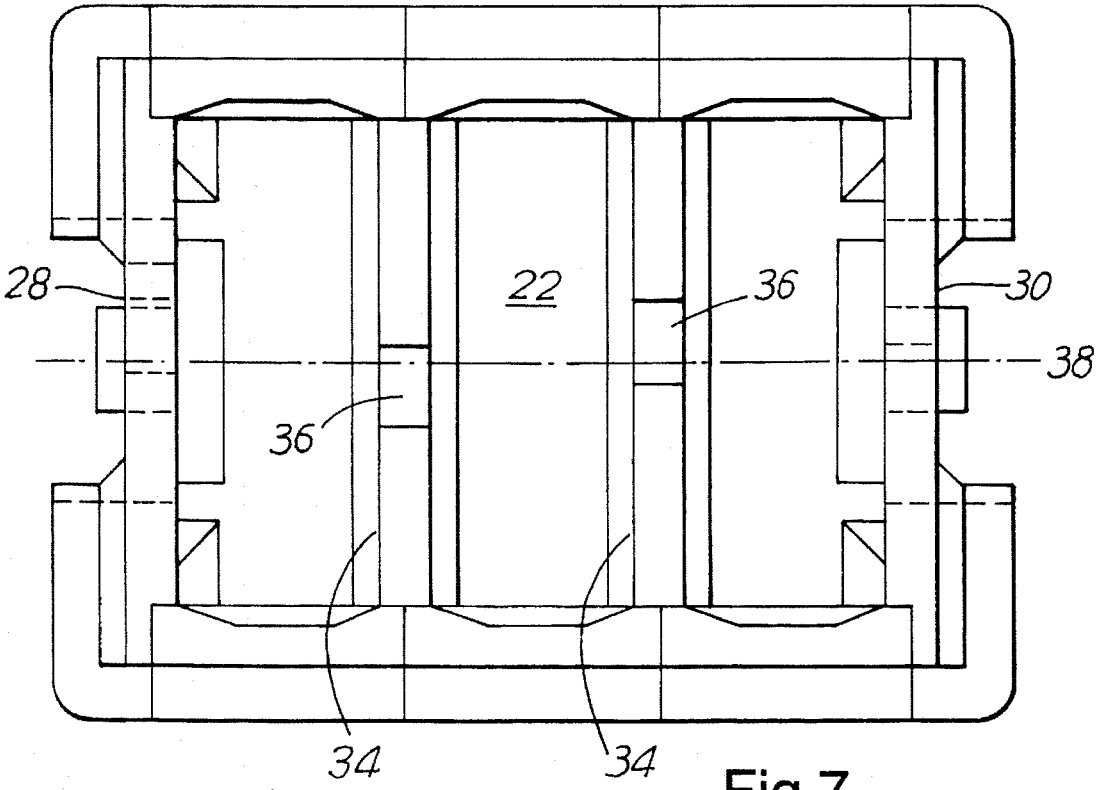
FIG. 7 is an underside view of the stuffer cap of FIG. 2.

As can be seen from FIGS. 5, 6, and 7, the interior of the stuffer cap has a plurality of parallel walls 34 which extend between the centres of pairs of recesses in the side walls. The end walls 28, 30 constitute two such walls. The walls each include a slot 36 in their mid portions. The slots are offset, alternately on opposite sides of the longitudinal axis 38 of the stuffer cap and correspond to the positions of the insulation displacement contacts in the housing 10.

The end walls 28,30 have a recess 40 at their upper ends (FIG. 6) in which is located a latch 42. As can be seen from FIG. 4, the latch has an outwardly extending bead portion 44 having an outer contact point 46 and a latching point 48 arranged at opposite ends of an engaging face or contact area 50.

In use, wires to be connected are laid across slits 14 in the insulation displacement connector, above the contacts with which they are to be engaged. The stuffer cap is placed over the connector and rests with the recesses 32 each surrounding a wire. The end walls 28, 30 and the other lateral walls 34 push the wires into the insulation displacement contacts. When pushed fully home, the slots 36 in the walls are positioned over a respective contact.

As the cap is pushed towards the insulation displacement connector, the contact points 46 of the latches on the end walls will engage with the respective ledges 18 on teeth of the housing. The ledges will force the latch beads 44 towards one another against their natural resilience until the contact points have passed the lower edge of the ledge. The engaging face 50 of the bead will then slide over the lower edge of the ledge until eventually latching point 48 slides underneath the ledge and extends with its own resilience into the recess defined by the ledge, holding the stuffer cap snapped into position on the insulation displacement connector.

Figure 8:
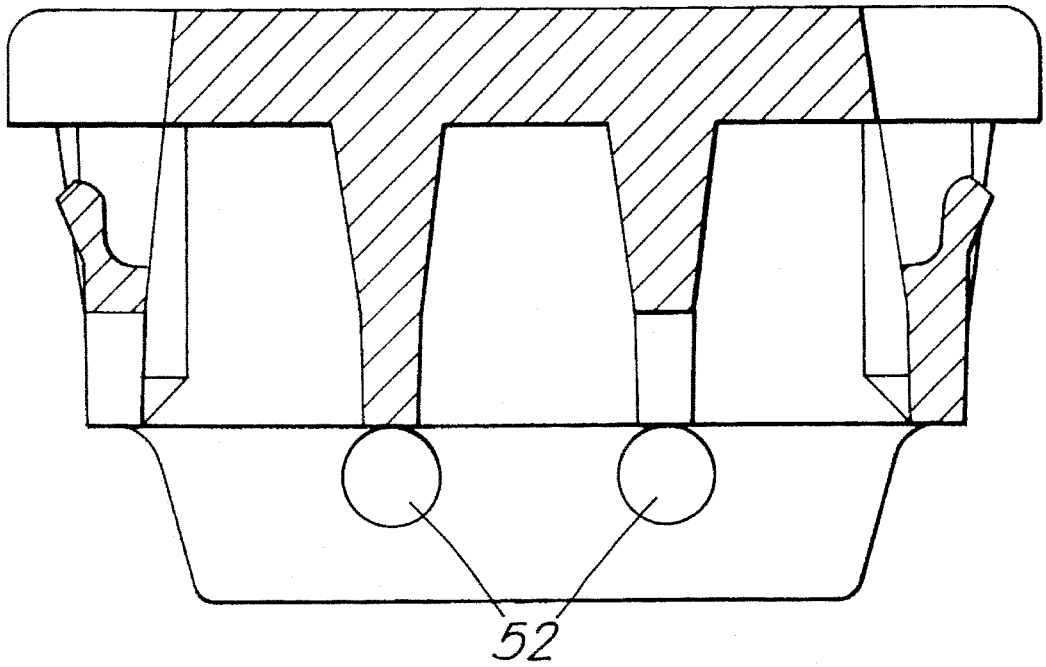
FIG. 8 is a similar view to FIG. 4 showing an embodiment of a second aspect of the invention.

Referring to FIG. 8, the embodiment illustrated is similar to that described except that the recess 32 have been blocked off and apertures 52 formed in their place.

To insert wires into the insulation displacement connector the wires are first fed through a pair of opposed apertures 52 in the side walls and then the stuffer cap is forced onto the housing. As the wires remain enclosed by the stuffer cap they can be removed from the insulation displacement contacts by removal of the stuffer cap.

Figure 9:
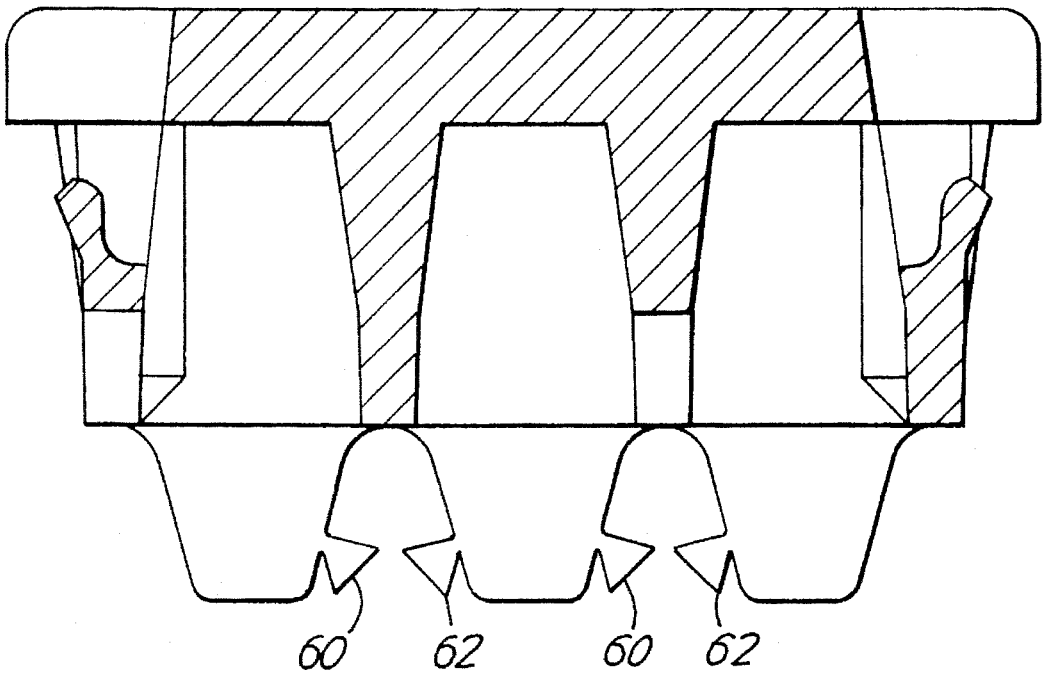
FIG. 9 is a similar view to FIG. 8 showing an embodiment of a further aspect of the invention.
Figure 10:
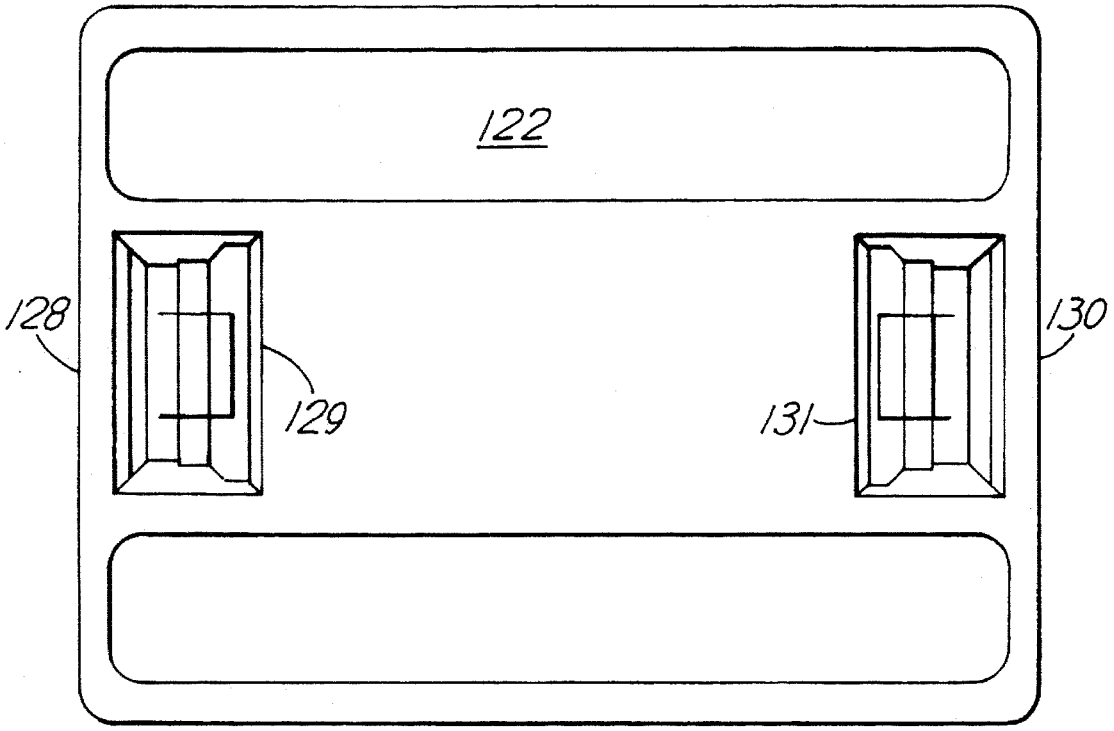
FIG. 10 is a top view of an alternative embodiment of the aspect of the invention illustrated in FIGS. 2 to 7.
Figure 11:
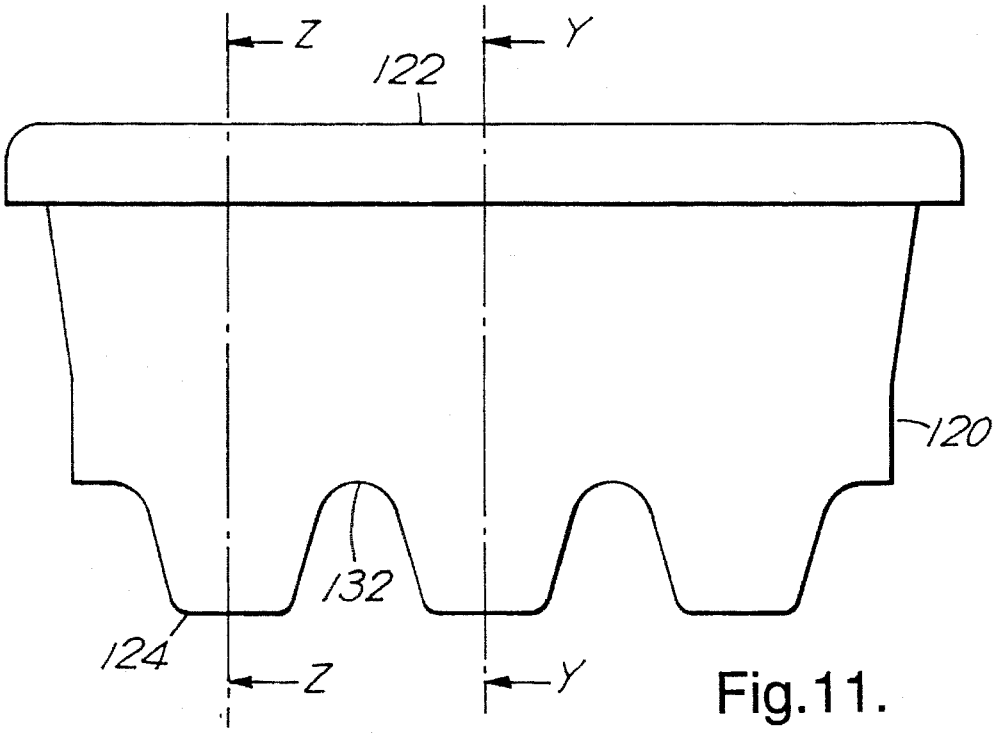
FIG. 11 is a side view of the embodiment of FIG. 10.
Figure 12:
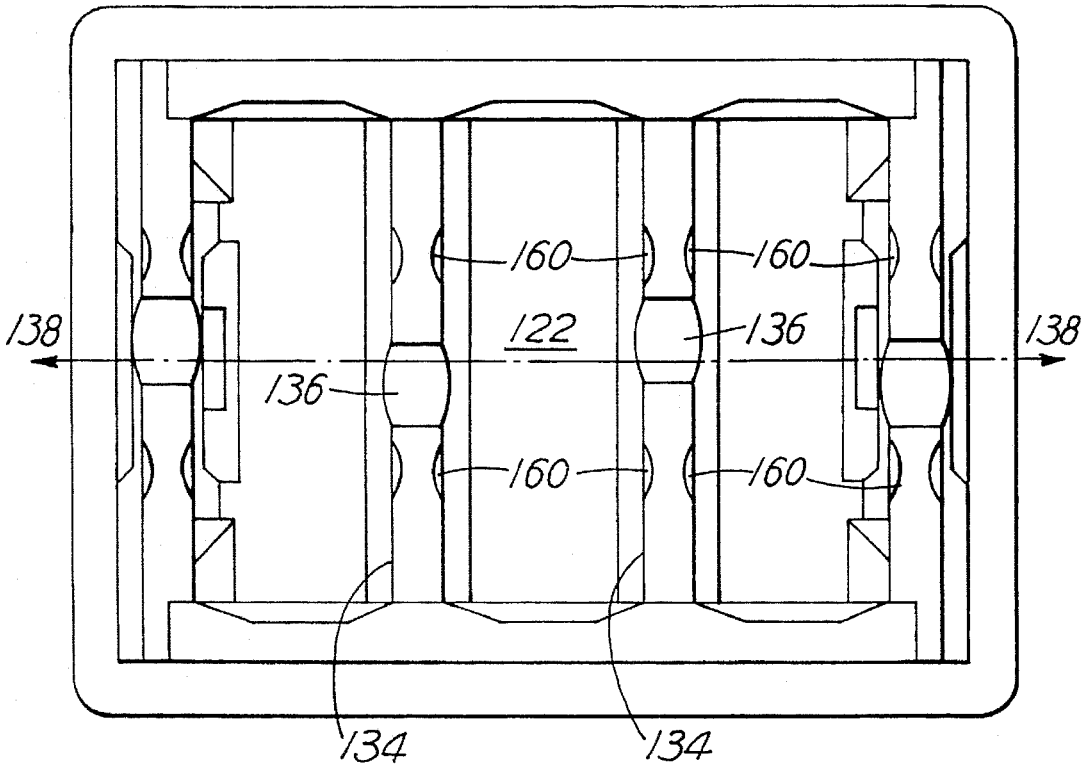
FIG. 12 is an underside of the FIG. 10 embodiment.
Figure 13:
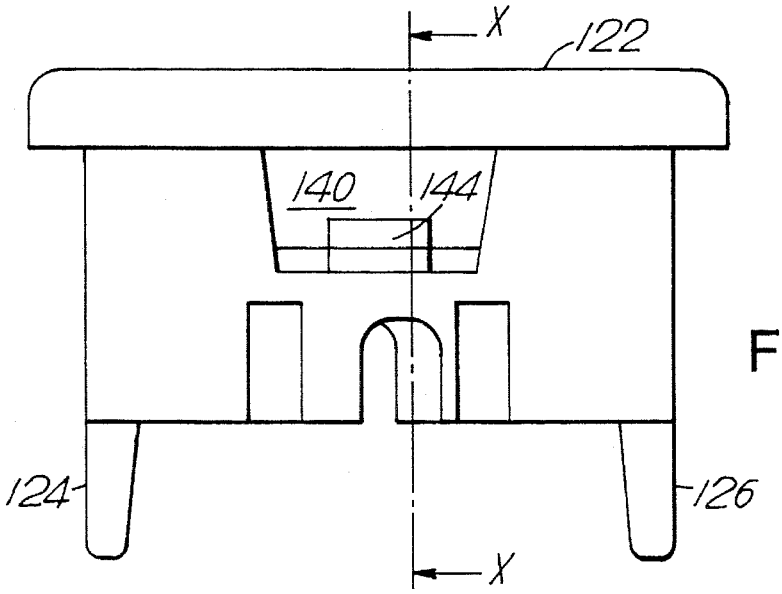
FIG. 13 is an end view of the FIG. 10 embodiment.
Figure 14:
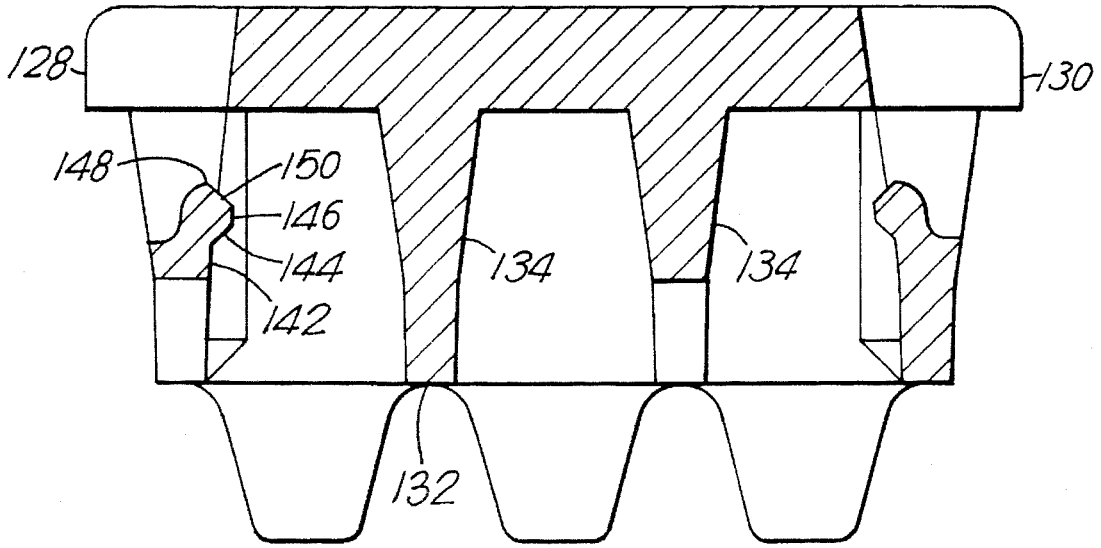
FIG. 14 is a view on the line X—X in FIG. 13.

The embodiment of FIG. 9 enables removal of wires from contacts irrespective of whether they have been engaged with the insulation displacement contacts using the stuffer cap, for example using a wire connection tool. The construction is similar to that of the embodiment of FIGS. 2 to 7, however, a latching mechanism is attached to the walls of the recesses 32 on the side walls. The latch comprises a pair of resilient hook members 60,62. One on each side wall of the recess. The hook members are resilient when force is applied in a direction towards the interior of the cap (arrow A in FIG. 9) and when force is applied in the opposite direction.

The stuffer cap is applied in the same manner as described with respect to FIGS. 2 to 7 and the hook members 60,62 will bend back against their natural resilience and spring back underneath the wire. As the hooks are rigid when force is applied from the opposite direction they will act to disconnect wires from their contacts when the stuffer cap is removed. This embodiment may be used to remove wires which are already in position on the insulation displacement connector.

Turning now to FIGS. 10 to 16 there is illustrated an alternative embodiment to the embodiment of FIGS. 2 to 7. In the following description the same references are used, increased by 100. Where elements of the drawing are not described they are the same as the FIG. 2 to 7 embodiment.

In the FIG. 10 to 16 embodiment the latch 142 has been reversed, such that snap bead 144 extends inwardly towards the interior of the stuffer cap body. The recesses in the end walls 128, 130 are replaced by rectangular apertures 129, 131, the walls 128, 130 being continuous. As can be seen from FIG. 16, the snap beads 144 are rectangular extending from the inner faces of the end walls 128, 130 above the lower wall of aperture 140 in their ends.

Location of the stuffer cap on the insulation displacement connector is similar to that described with respect to FIGS. 2 to 7. However, it will be appreciated that the snap bead will latch with the ledge 18 of the connector opposite to that with which the outwardly extending latch engages.

Figure 15:
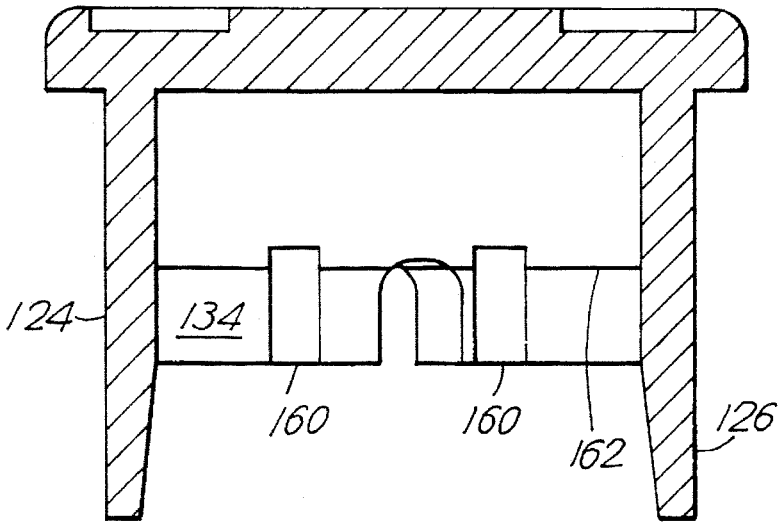
FIG. 15 is a view on the line Y—Y in FIG. 11.
Figure 16:
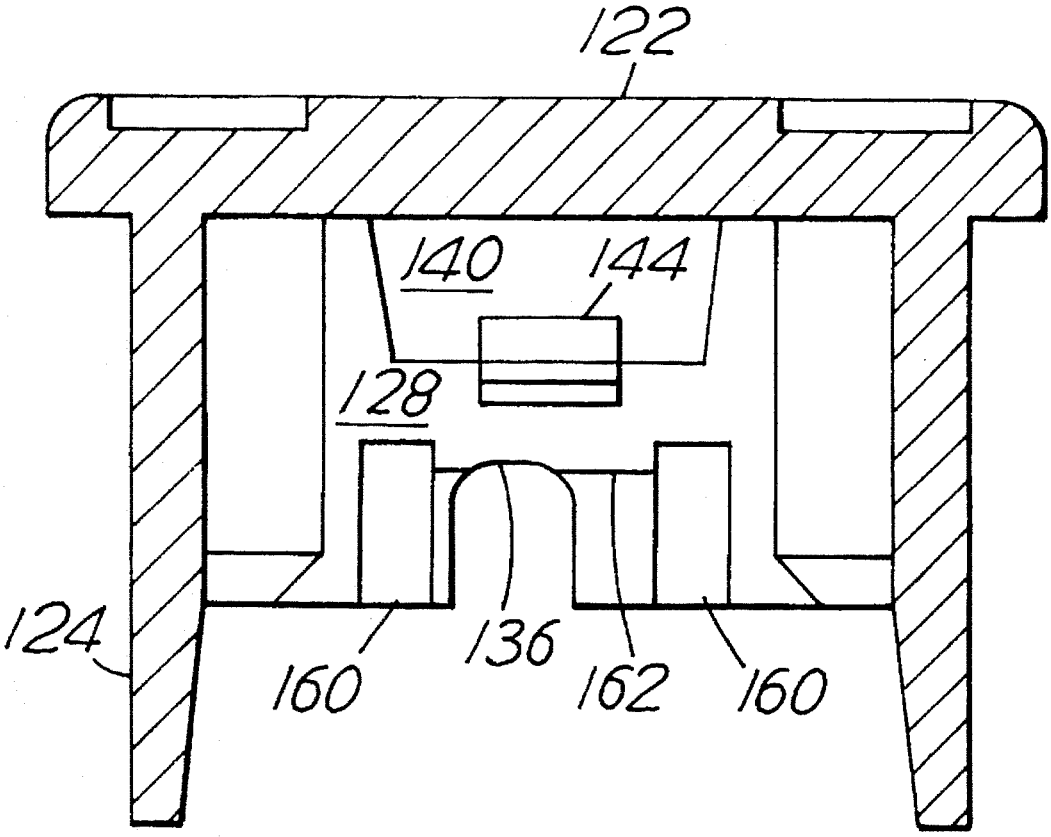
FIG. 16 is a view on the line Z—Z in FIG. 11.

In addition, each of the end walls and the internal parallel walls 134 carry curved grooves 160 on their lower ends. These grooves are located on each side of the end walls 128, 130 and the two internal walls 134, one on each side of the centre axis 138 spaced equidistant therefrom. Thus, each of the four walls carry four grooves. FIGS. 15 and 16 show how these grooves extend from the free ends of the walls to just after the beginning of the tapered portions indicated by line 162. The grooves assist in the location of the stuffer cap over the wire clamping features of the connector, by, for example, engaging with corresponding ribs protruding from the walls on either side of the slits 14 shown in the connector of FIG. 1.

The embodiments of FIGS. 8 and 9 may be incorporated into the FIGS. 10–16 embodiment in the same way as described with respect to the FIGS. 2 to 7 embodiment.

What is claimed is:

1. A stuffer cap for an insulation displacement connector having a body including at least one recess, said stuffer cap comprising:

a body having a top, an opposed pair of side walls, an opposed pair of end walls, the end walls being continuous and at least one intermediate wall between said opposed end walls and substantially parallel thereto, and retaining means for retaining said stuffer cap in position on said insulation displacement connector;

wherein said retaining means comprises a latch arranged on at least one of said opposed continuous end walls of the cap body for engagement in a recess in said insulation displacement connector body;

an aperture, in which said latch is arranged;

said aperture being bordered on three sides by portions of the continuous end wall and on a fourth side by the top of the body; and the latch extending from the end wall upwardly and inwardly toward the top of the body and having a snap bead extending in a direction inwardly toward the interior of the stuffer cap body.

2. The stuffer cap of claim 1, wherein said opposed pair of side walls includes a plurality of second apertures aligned with said opposed pair of end walls and said at least one intermediate wall, said plurality of apertures being positioned towards the free edges of said opposed pair of side walls below the bottom of said opposed pair of end walls and said at least one intermediate wall.

3. The stuffer cap of claim 1, wherein said at least one recess in said insulation displacement connector includes a ledge, and the snap bead of the latch slides over the ledge to retain the stuffer cap in engagement with the insulation displacement connector.

4. The stuffer cap of claim 1, further comprising a latch provided on each of said opposed pair of end walls.

5. The stuffer cap of claim 1, wherein said at least one recess in said insulation displacement connector includes a ledge and said latch comprises:

a resilient snap portion having a contact face for sliding over said ledge on said insulation displacement connector; and said latch further comprises a contact area for snap engagement with a surface of said ledge in said recess in said insulation displacement connector.

6. The stuffer cap of claim 1, wherein said latch means is resiliently biased towards said body of said stuffer cap.

7. The stuffer cap of claim 1, wherein said opposed pair of side walls have free ends having a plurality of recesses therein, said recesses being aligned with said opposed pair of end walls and said at least one intermediate wall, said recesses each having a side having a free end and a hook means extending from said side, said hook means being resilient to force applied in a direction extending from the free end of the side wall to the base and rigid to force applied in an opposed direction.

8. The stuffer cap of claim 7, wherein said recesses are substantially U-shaped and said hook means comprises first and second hook portions arranged on opposite sides of said recesses.

9. The stuffer cap of claim 1, wherein said opposed pair of side walls of said body comprise a plurality of apertures aligned with said opposed pair of end walls and said intermediate wall, said plurality of apertures being arranged towards free edges of said side walls below the bottom of said opposed pair of end walls and said intermediate wall.

10. The stuffer cap of claim 9, wherein said insulation displacement connector body defines a plurality of said recesses, and wherein said retaining means comprises a latch means arranged on each wall of said opposed pair of end walls for engagement in a corresponding recess in said insulation displacement connector body.

11. The stuffer cap of claim 10, wherein said plurality of recesses of said insulation displacement connector body include a ledge means each said latch means comprises:

a resilient snap portion defining a contact face for sliding over said ledge means of a corresponding one of said recesses in said insulation displacement connector body; and a contact area for snap engagement with a surface of said ledge means of said corresponding one of said recesses.

12. The stuffer cap of claim 10, wherein each said latch means is resiliently biased towards said base of said stuffer cap.

13. The stuffer cap of claim 10, further comprising a pair of apertures, each of said pair of apertures being defined partly by a respective one of said pair of end walls and partly by said base of said stuffer cap body, wherein each said latch means is arranged in a respective one of said apertures.

14. The stuffer cap of claim 1 wherein each wall of said opposed pair of side walls has free ends which include a plurality of recesses, said recesses being aligned with the said opposed pair of end walls and said at least one intermediate wall, said recesses each having a side having a hook means extending therefrom, said hook means being resilient to force applied in a direction extending from said free ends to the base and rigid to force applied in an opposite direction thereto.

15. The stuffer cap of claim 14, wherein said retaining means comprises a latch means arranged on at least one wall of said opposed pair of end walls for engagement in said recess in said insulation displacement connector body.

16. The stuffer cap of claim 15, wherein said recess in said insulation displacement connector body includes a ledge, and said latch means comprises:

a resilient snap portion defining a contact face for sliding over said ledge; and a contact area for snap engagement with a surface of said ledge.

17. The stuffer cap of claim 15, wherein said latch means is resiliently biased towards said base.

18. The stuffer cap of claim 15, further comprising an aperture defined partly by one wall of said opposed pair of end walls and partly by said base, the latch means being disposed in said aperture.

19. The stuffer cap of claim 16, comprising a pair of latch means each arranged on a respective wall of said opposed pair of end walls and each engaging in a respective recess in said insulation displacement connector body.

* * * * *